US009428979B2

(12) United States Patent
Bell et al.

(10) Patent No.: US 9,428,979 B2
(45) **Date of Patent: *Aug. 30, 2016**

(54) SHAPED CHARGE CASING CUTTER

(71) Applicants: William T. Bell, Hunstville, TX (US); James G. Rairigh, Houston, TX (US)

(72) Inventors: William T. Bell, Hunstville, TX (US); James G. Rairigh, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/721,843

(22) Filed: May 26, 2015

(65) Prior Publication Data

US 2015/0345245 A1 Dec. 3, 2015

Related U.S. Application Data

(63) Continuation-in-part of application No. 14/120,528, filed on May 29, 2014, now Pat. No. 9,038,713.

(51) Int. Cl.

| | |
|---|---|
| ***E21B 29/02*** | (2006.01) |
| ***E21B 43/117*** | (2006.01) |
| ***F42B 1/028*** | (2006.01) |
| ***F42B 3/00*** | (2006.01) |
| *F42B 1/02* | (2006.01) |

(52) U.S. Cl.

CPC ..... *E21B 29/02* (2013.01); *E21B 43/117* (2013.01); *F42B 1/028* (2013.01); *F42B 3/006* (2013.01); *F42B 1/02* (2013.01)

(58) Field of Classification Search

CPC .... E21B 29/02; E21B 43/116; E21B 43/117; F42B 1/02; F42B 1/04; F42B 3/08

USPC ..... 102/306, 307, 309, 310; 166/55; 89/1.15

See application file for complete search history.

(56) References Cited

U.S. PATENT DOCUMENTS

| | | | | |
|---|---|---|---|---|
| 3,233,688 | A * | 2/1966 | Bell | E21B 29/02 102/307 |
| 4,354,433 | A | 10/1982 | Owen | |
| 4,724,105 | A * | 2/1988 | Owen | B26F 3/04 102/307 |
| 5,046,563 | A * | 9/1991 | Engel | F42B 3/08 102/310 |
| 6,016,753 | A * | 1/2000 | Glenn | B26F 3/04 102/307 |
| 6,505,559 | B1 * | 1/2003 | Joslin | F42D 3/00 102/307 |
| 6,792,866 | B2 | 9/2004 | Grattan | |
| 2006/0075888 | A1 * | 4/2006 | Yang | F42B 3/08 89/1.14 |

* cited by examiner

*Primary Examiner* — Robert E Fuller
*Assistant Examiner* — David Carroll

(57) ABSTRACT

A shaped charge casing cutter is constructed with the cutter explosive formed into radial section modules aligned in a toroidal cavity between a pair of housing plates. The center sections of the housing plates are contiguously aligned with opposite parallel surfaces of a center disc. The housing plates comprise annular edges or rims, and the rims can be offset from respective center disc planes in opposite directions from each other to form a toroidal cavity. The toroidal cavity is enclosed by a circumferential belt secured to said housing plate rims. V-grooved shaped charge explosive in the form of multiple pi sections is distributed about the cavity to intimately contact a pair of frusto-conical liners. Assembly tolerance space between the pi sections is filled by dense paper card stock.

21 Claims, 5 Drawing Sheets

SHAPED CHARGE CASING CUTTER

CROSS-REFERENCE TO RELATED APPLICATIONS

This application is a continuation-in-part of and claims priority to pending U.S. patent application Ser. No. 14/120,528, entitled "Shaped Charge Casing Cutter," filed May 29, 2014.

STATEMENT REGARDING FEDERALLY SPONSORED RESEARCH OR DEVELOPMENT

Not Applicable

FIELD OF THE INVENTION

The present invention relates to shaped charge tools for explosively severing tubular goods including, but not limited to, pipe, tube, casing and/or casing liner.

BACKGROUND OF THE INVENTION

The capacity to quickly, reliably and cleanly sever a pipe or well casing deeply within a wellbore is an essential maintenance and salvage operation in the petroleum drilling and exploration industry. Cutting large, 7 inch to 20 inch nominal diameter casing and casing liner is particularly challenging. Generally, the industry relies upon mechanical, chemical or pyrotechnic devices for such cutting. Among the available options, shaped charge (SC) explosive cutters are often the simplest, fastest and least expensive tools for cutting pipe in a well. The devices are typically conveyed into a well for detonation on a wireline or length of coiled tubing.

Typical explosive pipe cutting devices comprise a consolidated wheel of explosive material having a V-groove perimeter similar to a V-belt drive sheave. The surfaces of the circular V-groove are clad with a thin metal liner. Pressed contiguously against the metal liner is a highly explosive material such as HMX, RDX or HNS.

This V-grooved wheel of shaped explosive is aligned coaxially within a housing sub and the sub is disposed internally of the pipe that is to be cut. Accordingly, the plane that includes the circular perimeter of the V-groove apex is substantially perpendicular to the pipe axis.

Upon ignition of the explosive, the explosion shock wave reflects off the opposing V surfaces of the grooved wheel to focus onto the respective metal liners. The opposing liners are driven together into a collision that produces a fluidized mass of liner material. Under the propellant influence of the high impingement pressure, this fluidized mass of liner material flows lineally and radially along the apex plane at velocities in the order of 22,000 ft/sec, for example. Resultant impingement pressures against the surrounding pipe wall may be as high as 6 to $7\times10^6$ psi thereby locally fluidizing the pipe wall material.

This principle may be applied to large diameter pipe such as well casing which may be cut while positioned within a wellbore with a toroidal circle of explosive having an outside face formed in the signatory V-groove cross-section. This toroidal circle of explosive is placed and detonated within a toroidal cavity of a housing. However, formation of an explosive torroid of sufficient size to sever a large diameter casing requires relatively large quantities of explosive. As an integral unit, such quantities of explosive exceed prudent transportation limitations. For practical reasons of transport and safety, therefore, the mass of the toroidal explosive circle is divided into multiple, small quantity modules of cross-sectional increments which are transported to a well site in separate, isolated packages.

Explosively cutting a 20 inch casing may require a shaped charge of as much as 1000 gms. (35.27 ounces) of high explosive (ex. HMX). However, international standards of transportation safety (United Nations Recommendations on the Transport of Dangerous Goods, Edition 17, Vol. I, Chapter 2.1, Division 1.4) limit the public transport of a single unit of hazard class or high explosive to 45 gm (1.59 ounces). Consequently, to transport a shaped charge cutter of size sufficient to cut a 20 inch casing, it is essential for the explosive elements of the cutter to be designed for shipment as a multiplicity of small, less than 38 gm./unit, modules configured for operational assembly at the point of use.

Unfortunately, the environmental circumstances of a drilling rig floor, which is where final cutter assembly must occur, are often severe and usually not conducive to the attentive care required for final assembly of a high explosive tool. Hence, there are strong incentives to design the individual explosive modules with the greatest degree of assembly ease and tolerance. But large module assembly tolerance often results in collective space between modules. In the case of modular assembly for shaped charges, such assembly space can severely diminish the cutter capability.

Other issues for large diameter casing cutters arise with deep wells under considerable hydrostatic pressure. Large surface areas for prior art casing cutter housings may be distorted under deep well fluid pressure, also resulting in reduced cutting capacity or a malfunction of the tool.

BRIEF SUMMARY OF THE INVENTION

The present casing cutter invention comprises several design and fabrication advantages including a substantially solid structural interior that is substantially impervious to high well pressure. Shaped charge explosive material is distributed in modules around the full circle of an approximate toroidal cavity that is held open against well pressure by a full-circle belting structure.

Preferably, the modules are further divided into smaller units corresponding to upper and lower half sections of the approximate toroid. The shaped charge metal liner is independently fabricated as a pair of matching cone frustums.

Collective tolerance space between the modules and modular units of explosive material is closed around the toroid circumference by paper card stock shims between adjacent explosive modules.

The back-side surfaces of the shaped charge assembly may be resiliently biased into intimate contact against the liner cone surfaces by an O-ring spring bearing upon the explosive module back-sides. A gap between the adjacent apex surfaces of the modules accommodates module fabrication tolerances.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
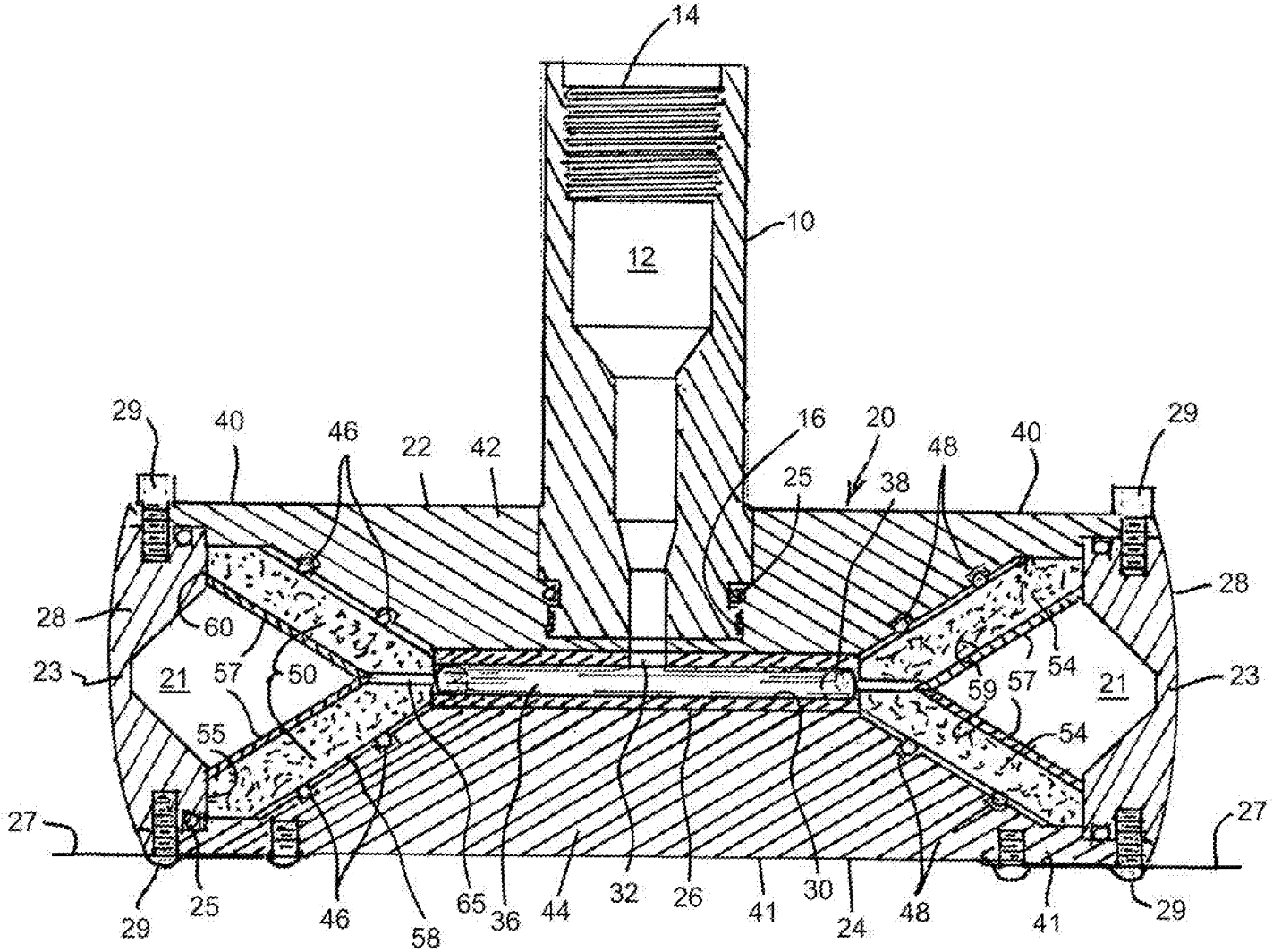
FIG. 1 is a cross-section of a preferred embodiment of the invention in assembly with the housing, centralizer and top sub.
Figure 10:
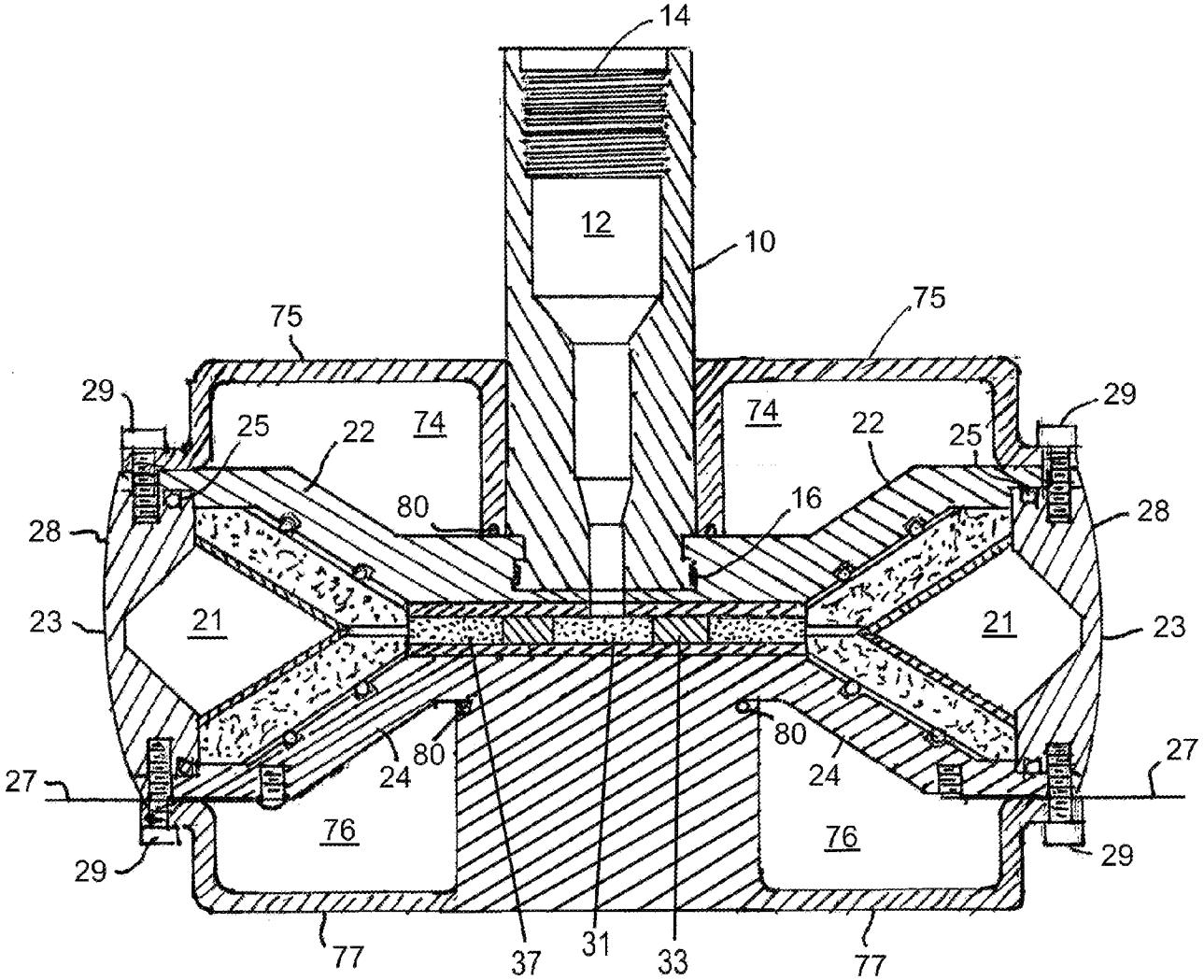
FIG. 10 is a cross-section of the invention provided with buffer chambers and an alternate detonation configuration.

Referring to FIG. 1, a top sub 10 is formed with an axial cavity 12 for receipt of a detonator sub-assembly not shown. Internal threads 14 proximate of the sub body upper end provide a convenient mechanism for securing the top sub 10 to a tubing string, for example. External threads 16, as shown in FIGS. 1 and 10, at the lower end of the top sub 10 secure the top sub to the upper housing plate 22 of the shaped charge housing 20.

The shaped charge housing 20 assembly basically comprises four major components. Upper and lower housing plates 22 and 24 are separated by initiation spool 26. The housing plates and initiation spool are all of substantially circular perimeter. The upper and lower housing plates 22 and 24 are secured into a belting ring 28 with a plurality of threaded fasteners 29. Notably, the belting ring fit with the housing plate perimeters is designed to oppose distortions and closure of the toroidal cavity 21 between the plate perimeters due to high external fluid pressure. O-ring seals 25 environmentally secure the toroidal cavity 21 around the housing perimeter inside of the belting ring. The belting ring outside diameter is only slightly less than the inside diameter of the casing that is to be severed. Centering springs 27 may be secured to the housing to project radially outward by a predetermined distance determined by the internal diameter of the casing to be severed.

The belting ring 28 thickness is notched about its internal perimeter to provide a narrow penetration band 23 in the radial expansion plane of the shaped charge cutting jet.

Figure 3:
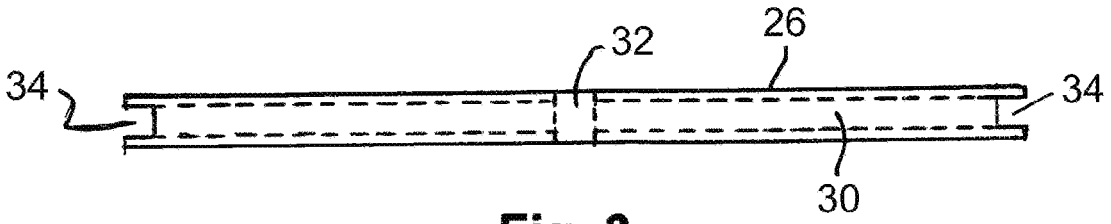
FIG. 3 is an elevation view of the initiation spool.
Figure 2:
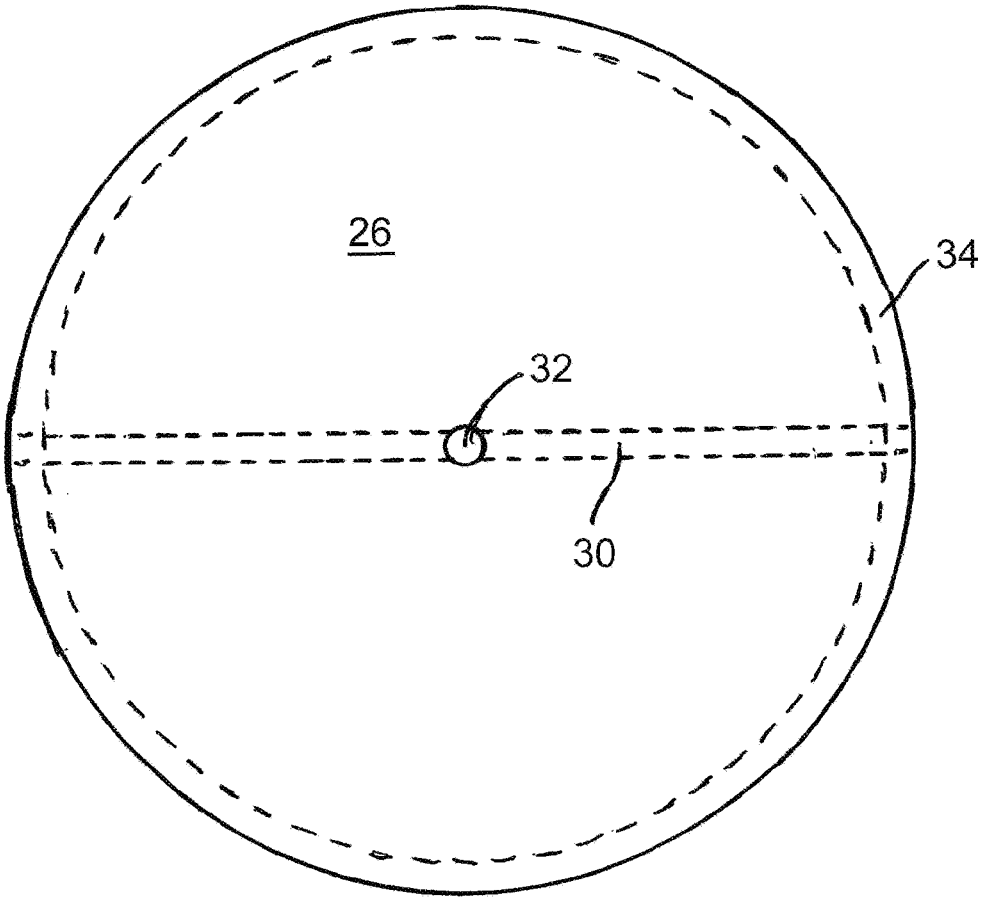
FIG. 2 is a plan view of the initiation spool.

Referring to FIGS. 2 and 3, the initiation spool 26 may be a substantially solid disc having parallel face planes and at least one transverse detonator cord boring 30 between the face planes that is intersected at the disc center by a detonator aperture 32. The perimeter of the disc is channeled by a detonator cord confining groove 34. Preferably, the transverse detonator cord 36 is continuous between opposite outer perimeters of the initiation spool 26 for termination at close adjacency against adjacent detonator cord in the confining groove 34, while confining groove 34 is in close adjacency against explosive units 54. The two arcuate cord portions 38 that form a detonating circle have respective opposite distal ends that terminate against side elements of the transverse cord.

With further reference to FIG. 1, the upper and lower housing plates 22 and 24 are formed to substantially the same profile. In an embodiment, the annular edges 40 and 41 of the respective housing plates 22 and 24 are substantially concentric with corresponding center sections 42 and 44. The annular edge 40 of the upper plate 22 is in parallel alignment with the plane of the circular plate center section 42. As a mirror reflection, the annular edge 41 of the lower housing plate 24 is in parallel with the plane of the circular plate center section 44.

Figure 4:
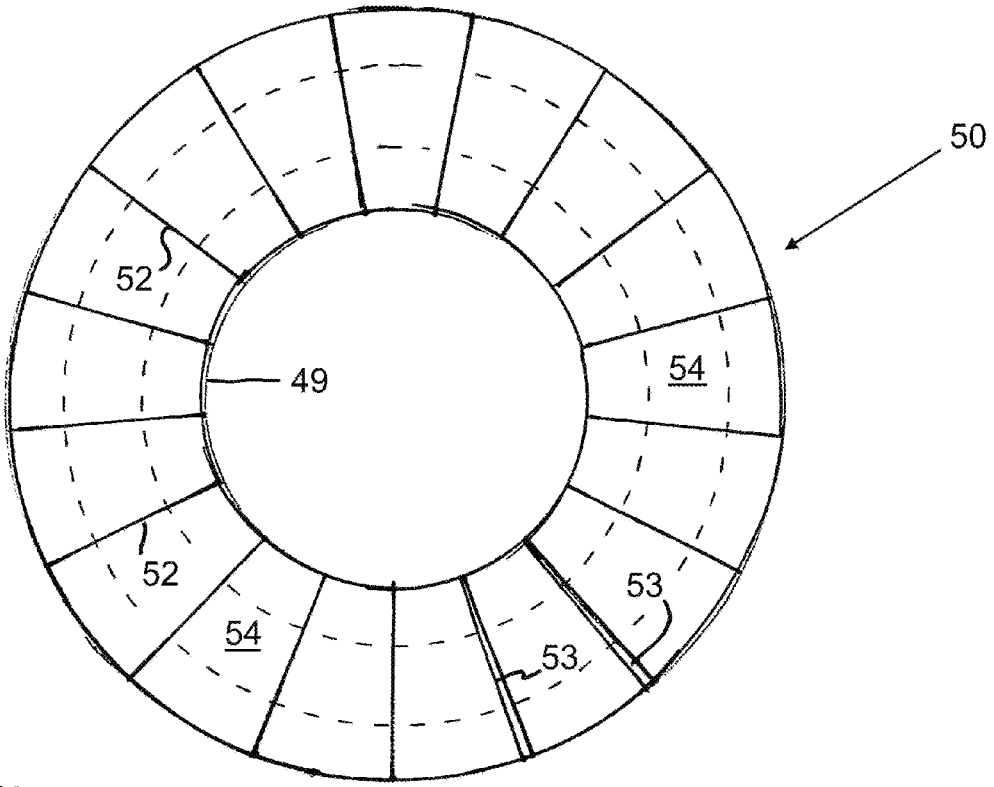
FIG. 4 is a plan view of the explosive assembly.
Figure 5:
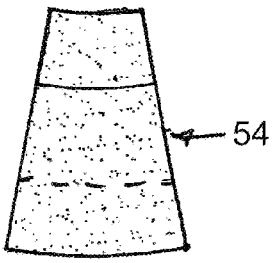
FIG. 5 is a plan view of an individual explosive unit.
Figure 6:
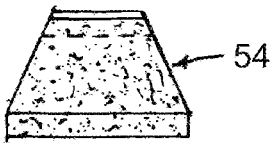
FIG. 6 is an end elevation view of an individual explosive unit.
Figure 7:
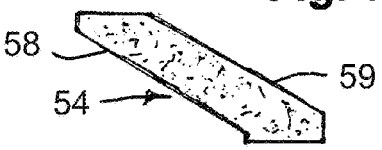
FIG. 7 is a side elevation view of an individual explosive unit.

An approximately toroidal cavity 21 is formed within the interior surfaces of the plate rims and the belting ring to confine a circular assembly of explosive modules 50. Each module 50 is a radial increment of a shaped charge circle. The plan view of FIG. 4 illustrates the circular alignment of the modules 50 with juxtaposed radial joint planes 52. Each module 50 comprises a matching pair of explosive units 54, with no unit exceeding 45 gms. of explosive, for example. The three orthographic views of FIGS. 5, 6 and 7 show a single unit 54 having a body 56 of compressed, high explosive material.

As the individual units are positioned against a respective housing plate interior surface 49 in the circle illustrated by FIG. 4, it will be understood that each unit must be formed to a small undersize tolerance for assembly convenience. When all of the units are positioned and pressed together, collectively, this necessary tolerance is accumulated as an intolerable space between the first and last units that may be 0.254 mm (0.010 inches) or more. Leaving such a space may severely influence the shaped charge performance. An unfilled inter-unit space of 1.588 mm (0.0625 inches) has been measured to reduce cutting penetration by half. Of course, this space may be packed with loose explosive but such a solution is not only time consuming but hazardous.

Filling the spaces with metallic shims has also been found to be unsatisfactory. Cutting performance is nevertheless reduced. Surprisingly, it has been found that the spaces may be filled with "card stock" paper shims 53 without measurable loss of cutting penetration. Typical specifications for card stock paper include a paper sheet that is calendared to an approximate density range of 135 to 300 g/m$^2$ (3.982 oz./yd. to 8.848 oz./yd.) and thickness range of 0.254 mm to 0.381 mm (0.01 in. to 0.015 in). In practice, the card stock shim is cut into the section shape of an explosive unit as shown by FIG. 7 and inserted in the space between adjacent explosive units 54. Preferably, only one card stock shim is positioned between an adjacent pair of explosive units 54. Collective spaces greater than a single card stock thickness may be closed by inserts between multiple pairs of explosive units and/or modules.

It has long been believed that intimate contact of the shaped charge explosive material with the interior surface 49 of the housing structure enhanced the cutting energy release. U.S. Pat. No. 6,505,559 to J. Joslin et al. assumed this relationship by their disclosed use of "glue" to secure segmented explosive units to a backing plate. However, when practiced in the environment of a drilling rig floor, the difficulties of gluing explosive units in place are numerous. Moreover, Applicants have discovered the intimate relationship to be less critical than originally believed.

Of far greater importance is the intimate relationship of the explosive with the contiguous liner. In the prior art fabrication process, the independently formed metallic liner is placed in a molding receptacle and powdered explosive distributed over the liner. Subsequently, a forming die is forced against the powdered explosive to compact it against the liner surface and adhere it intimately thereto.

The present invention procedure calls for a partial assembly of the shaped charge housing 20 by attaching the belting ring 28 to the lower housing plate 24 by means of fasteners 29. Additionally, the initiation spool 26 is centered upon the lower plate center section 44. This provides an open but walled circular channel within the belting ring interior perimeter. Within this circular channel, the appropriate number of explosive units 54 are positioned with the outer end face 55 of each explosive unit placed contiguously against the inner face 60 of the belting ring 28 while the inner end face of the explosive units 54 is positioned adjacent to the center section 44 outer perimeter. The outer face 58 of each explosive unit 54 is supported by two or more O-rings 46, 48. Contiguous continuity between the several units 54 about the module 50 circle is completed by inserting a required number of shims 53 between one or more pairs of units 54. Upon this assembly of explosive units 54, the conical frustum 57 of a first liner half is placed against the inner face 59 of the explosive units.

Figure 8:
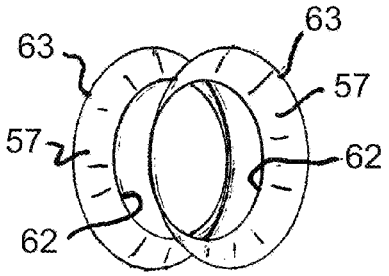
FIG. 8 is a pictorial view of the metallic liners.

Alignment of the upper half of the cutter ring onto the previously assembled lower half begins with positioning the minor diameter edge 62 of the upper frustum 57 against the minor diameter edge 62 of the lower frustum 57. See FIG. 8. If correctly dimensioned, the major diameter edge 63 of the upper frustum will be contiguously confined against the upper inside face 60 of the belting ring 28. The upper layer of explosive units 54 are placed upon the upper liner frustum with contiguous fits against the belting ring and initiation spool 26 outer perimeter. A sufficient number of shims 53 are positioned between adjacent pairs of explosive units 54 to complete the contiguous continuity.

When the shaped charge housing assembly 20 is completed by securing the upper housing plate 22 to the belting ring 28, the upper and lower plate O-rings 46, 48 exert a mutually opposed bias upon the explosive units 54 and the respective frustums 57.

It is important to note that the explosive unit 54 dimensions described above provide an open space 65 between the proximate explosive units 54 to accommodate other dimensional tolerance variations. In view of the tightly confined environment of Applicant's explosive cutter assembly and the consequential fluctuations of manufacturing tolerances, a free movement space for the units 54 is essential to assure intimate contact with the liner frustums 57. Although paper shims 53 successfully fill the circumferential tolerance space between adjacent explosive units 54, it is the resilient bias of the O-rings 46 that press the units 54 into necessary intimate contact with the liner material 57.

Figure 9:
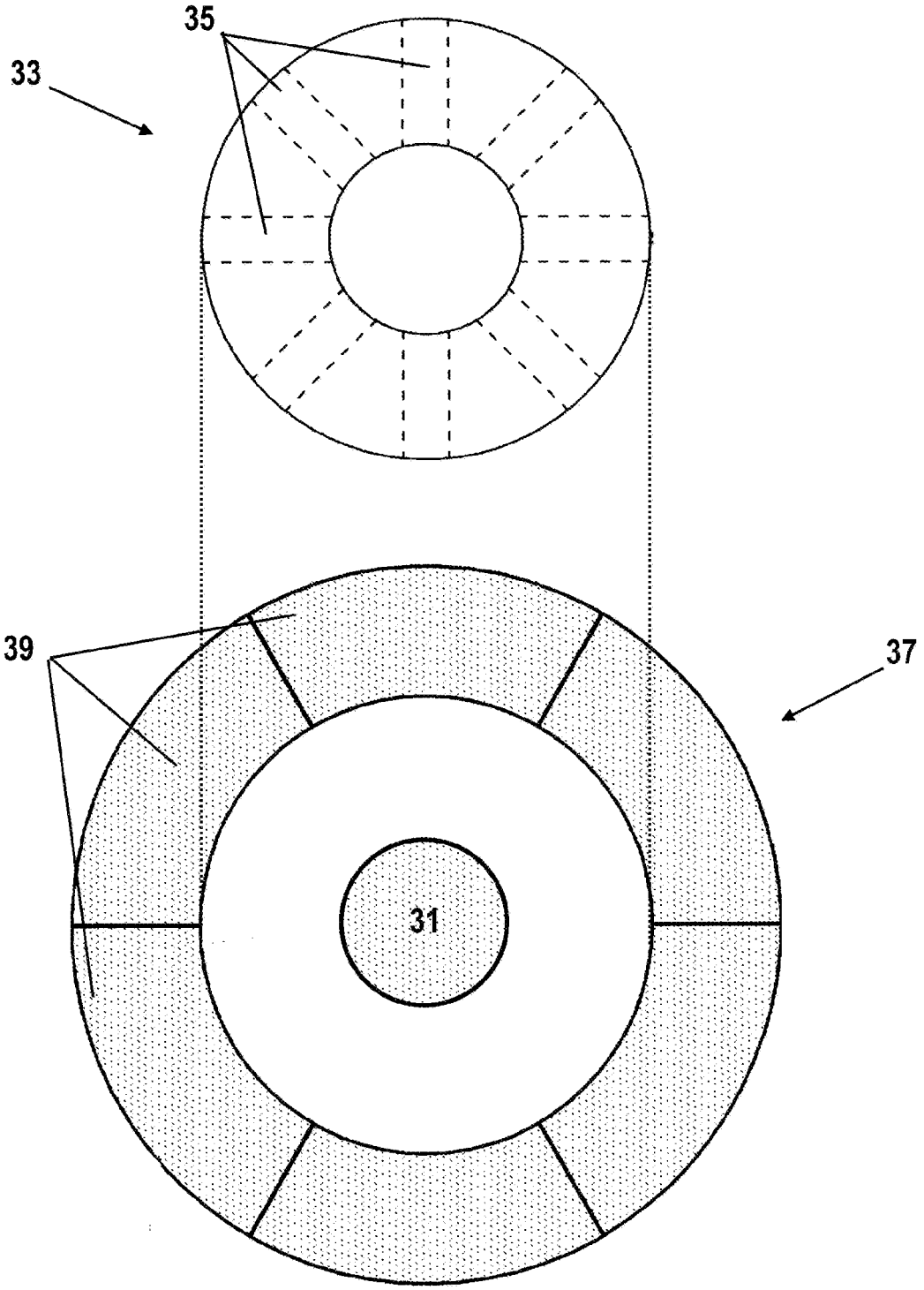
FIG. 9 is a plan view of an alternate initiation spool.

FIG. 9 illustrates an alternative embodiment of the invention ignition system in which two concentric layers of HMX comprising a center pellet 31 and an outer initiation pellet 37 are separated by a single initiation spool 33. In an embodiment, center pellet 31 is a single piece while outer initiation pellet 37 comprises a plurality of increments 39, none of which exceed regulatory and safety limits. In the depicted figure, the outer initiation pellet 37 is divided into six increments 39, although it can be appreciated that the segmentation can be greater or lesser depending on the shockwave profile and the regulatory transport requirements. Initiation spool 33 comprises a plurality of grooves 35 which focus and amplify the shock wave created by center pellet 31, allowing the invention to achieve higher working pressures and lessening the amount of explosive required to achieve equal detonation output to a solid explosive spool. As with the outer initiation pellet 37, while initiation spool 33 is depicted as having eight grooves 35, the configuration may vary.

FIG. 10 illustrates the above configuration in cross-section, showing center pellet 31, initiation spool 33, and outer pellet 37 within boring 30 created between the face planes of housing plates 22, 24.

As a further invention enhancement, FIG. 10 illustrates the invention housing as including buffer chambers 74 and 76 within annular channels 75 and 77. O-rings 80 seal the respective chamber volumes from the downhole fluid environment. The function of these annular channels 75 and 77 and buffer chambers 74 and 76 is to absorb and suppress energy reflections from the housing plates 22 and 24. Unbuffered, such reflected energy tends to disrupt the planar uniformity of the cutting disc as it erupts from the liner apex. A disturbed cutting disc results in a flared wall cut and an enlarged perimeter of "flash" on the pipe wall about the cutting plane. In can of course be appreciated that while these two improvements are illustrated together in FIG. 10, these buffer chambers could be used independently of the concentric nested ignition configuration of FIG. 9, and vice versa.

While a preferred embodiment of our invention has been illustrated in the accompanying drawings and described in the foregoing specification, it will be understood by those of skill in the art that additional embodiments, modifications and alterations may be constructed from the invention principles disclosed herein. These various embodiments have been described herein with respect to cutting a "pipe." Clearly, other embodiments of the cutter of the present invention may be employed for cutting any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

Having thus described the preferred embodiments, the invention is claimed as follows:

1. A shaped charge pipe cutter having a ring of shaped charge explosive, wherein the shaped charge pipe cutter comprises:

a plurality of radial modules, wherein each of said plurality of radial modules comprises radially aligned side planes, wherein a collective assembly tolerance space is formed between at least one pair of said radially aligned side planes of said plurality of radial modules, and wherein said collective assembly tolerance space is filled by at least one paper shim.

2. The shaped charge pipe cutter as described by claim 1, wherein said at least one paper shim is calendared to an approximate density range of 135 $g/m^2$ to 300 $g/m^2$.

3. The shaped charge pipe cutter as described by claim 1, wherein said at least one paper shim is calendared to an approximate thickness range of 0.01 inches to 0.015 inches.

4. The shaped charge pipe cutter as described by claim 1, wherein said at least one paper shim is calendared to an approximate density within a range of 135 $g/m^2$ to 300 $g/m^2$ and a thickness within a range of 0.01 inches to 0.015 inches.

5. A method of filling a collective tolerance space between a plurality of adjacent shaped charge explosive modules, wherein the steps for the method comprise:

assembling said plurality of adjacent shaped charge explosive modules in a circular or substantially circular configuration, wherein each of said plurality of adjacent shaped charge explosive modules comprises substantially radially aligned side planes; and inserting at least one shim of paper between at least one pair of said substantially radially aligned side planes of said plurality of adjacent shaped charge explosive modules.

6. The method of claim 5, wherein said at least one shim of paper is cut into the shape of one of said substantially radially aligned side planes of said plurality of adjacent shaped charge explosive modules for insertion between said at least one pair of said substantially radially aligned side planes.

7. The method of claim 5, wherein said at least one shim of paper has a thickness of approximately 0.010 inches to 0.015 inches.

8. The method of claim 5, wherein said at least one shim of paper has a density of approximately 135 g/m$^2$ to 300 g/m$^2$.

9. A shaped charge pipe cutter comprising:

a plurality of shaped charge explosive modules aligned in a substantially toroidal ring, wherein each of said plurality of shaped charge explosive modules comprises substantially radial side planes, and wherein at least one paper shim is inserted between said substantially radial side planes of an adjacent pair of said plurality of shaped charge explosive modules.

10. The shaped charge pipe cutter as described by claim 9, wherein adjacent side planes of remaining modules of said plurality of shaped charge explosive modules aligned in said substantially toroidal ring are contiguous.

11. The shaped charge pipe cutter as described by claim 9, wherein said at least one paper shim is formed in a shape of one of said substantially radial side planes.

12. The shaped charge pipe cutter as described by claim 9, wherein said at least one paper shim is formed from a paper card stock having a thickness of 0.010 inches to 0.015 inches.

13. The shaped charge pipe cutter as described by claim 9, wherein said at least one paper shim has a density in the range of 135 g/m$^2$ to 300 g/m$^2$.

14. A casing cutter comprising:

a substantially toroidal ring of explosive material having a V-groove outer perimeter, wherein said explosive material is segmented into a plurality of modules having substantially radial side planes, and wherein adjacent substantially radial side planes of at least two adjacent modules of said plurality of modules are separated by at least one paper shim.

15. The casing cutter described by claim 14, wherein remaining adjacent substantially radial side planes of remaining adjacent modules of said plurality of modules, arranged in said substantially toroidal ring, are contiguous.

16. The casing cutter described by claim 14, wherein said at least one paper shim has a density in the range of 135 g/m$^2$ to 300 g/m$^2$.

17. The casing cutter described by claim 14, wherein said at least one paper shim has a thickness in a range of approximately 0.010 inches to 0.015 inches.

18. A shaped charge casing cutter comprising:

an annular ring of explosive having a V-grooved outer perimeter, wherein said annular ring is segmented into a plurality of radial modules, wherein each of said plurality of radial modules comprises substantially radial side walls, and wherein at least one paperboard shim fills a space between at least one pair of adjacent substantially radial side walls.

19. The shaped charge casing cutter as described by claim 18, wherein remaining substantially radial side walls of adjacent modules of said plurality of radial modules, arranged in said annular ring, are contiguous.

20. The shaped charge casing cutter as described by claim 18, wherein said at least one paperboard shim has a density in the range of 135 g/m$^2$ to 300 g/m$^2$.

21. The shaped charge casing cutter as described by claim 18, wherein said at least one paperboard shim has a thickness in the range of approximately 0.010 inches to 0.015 inches.

* * * * *